US005882743A

United States Patent [19]

McConnell

[11] Patent Number: 5,882,743

[45] Date of Patent: Mar. 16, 1999

[54] ABSORBENT FOLDED HAND TOWEL

[75] Inventor: Wesley James McConnell, Alpharetta, Ga.

[73] Assignee: Kimberly-Clark Worldwide, Inc., Neenah, Wis.

[21] Appl. No.: 847,990

[22] Filed: Apr. 21, 1997

[51] Int. Cl.[6] ..... A47K 10/16; D21H 11/00

[52] U.S. Cl. ..... 428/12; 15/209.1; 428/124

[58] Field of Search ..... 428/12, 124; 15/209.1

[56] References Cited

U.S. PATENT DOCUMENTS

| | | | |
|---|---|---|---|
| 3,679,621 | 7/1972 | Morf et al. | 260/29.6 H |
| 3,798,120 | 3/1974 | Enloe et al. | 162/112 |
| 3,879,257 | 4/1975 | Gentile et al. | 162/112 |
| 3,903,342 | 9/1975 | Roberts, Jr. | 428/153 |
| 4,000,237 | 12/1976 | Roberts, Jr. | 264/128 |
| 4,093,765 | 6/1978 | Schmidt | 428/134 |
| 4,117,187 | 9/1978 | Adams et al. | 428/286 |
| 4,164,595 | 8/1979 | Adams et al. | 427/341 |
| 4,196,044 | 4/1980 | Mussoni et al. | 162/112 |
| 4,308,092 | 12/1981 | Latimer et al. | 162/111 |
| 4,351,699 | 9/1982 | Osborn, III | 162/112 |
| 4,406,737 | 9/1983 | Latimer et al. | 162/111 |
| 4,441,962 | 4/1984 | Osborn, III | 162/111 |
| 4,516,616 | 5/1985 | Fesler | 15/209.1 X |
| 4,623,576 | 11/1986 | Lloyd et al. | 428/171 |
| 4,882,221 | 11/1989 | Bogart et al. | 428/308.8 |
| 4,906,513 | 3/1990 | Kebbell et al. | 428/198 |
| 4,994,144 | 2/1991 | Smith et al. | 162/111 |
| 5,019,211 | 5/1991 | Sauer | 162/111 |
| 5,059,282 | 10/1991 | Ampulski et al. | 162/111 |
| 5,087,324 | 2/1992 | Awofeso et al. | 162/111 |
| 5,169,497 | 12/1992 | Sarkar et al. | 162/158 |
| 5,217,576 | 6/1993 | Van Phan | 162/158 |
| 5,223,096 | 6/1993 | Phan et al. | 162/158 |
| 5,245,025 | 9/1993 | Trokhan et al. | 536/56 |
| 5,262,007 | 11/1993 | Phan et al. | 162/158 |
| 5,264,082 | 11/1993 | Phan et al. | 162/158 |
| 5,277,761 | 1/1994 | Van Phan et al. | 162/109 |
| 5,334,286 | 8/1994 | Van Phan et al. | 162/158 |
| 5,354,425 | 10/1994 | Mackey et al. | 162/135 |
| 5,384,013 | 1/1995 | Husband et al. | 162/168.1 |
| 5,385,642 | 1/1995 | Van Phan et al. | 162/112 |
| 5,385,643 | 1/1995 | Ampulski | 162/135 |
| 5,389,204 | 2/1995 | Ampulski | 162/135 |
| 5,397,435 | 3/1995 | Ostendorf et al. | 162/112 |
| 5,399,412 | 3/1995 | Sudall et al. | 428/153 |
| 5,405,501 | 4/1995 | Phan et al. | 162/127 |
| 5,427,652 | 6/1995 | Darlington et al. | 162/164.3 |
| 5,429,854 | 7/1995 | Currie et al. | 428/138 |
| 5,431,783 | 7/1995 | Honig | 162/164.1 |
| 5,437,766 | 8/1995 | Van Phan et al. | 162/127 |
| 5,443,691 | 8/1995 | Phan et al. | 162/115 |
| 5,466,337 | 11/1995 | Darlington et al. | 162/164.3 |
| 5,494,731 | 2/1996 | Fereshtehkhou et al. | 428/211 |
| 5,503,715 | 4/1996 | Trokhan et al. | 162/296 |
| 5,525,345 | 6/1996 | Warner et al. | 424/402 |
| 5,804,279 | 9/1998 | Pluth | 428/124 |
| 5,813,080 | 9/1998 | Hendren | 15/209.1 |

FOREIGN PATENT DOCUMENTS

| | | |
|---|---|---|
| 1093879 | 1/1981 | Canada . |
| 1191727 | 8/1985 | Canada . |
| 85/03316 | 8/1985 | WIPO . |
| 94/03677 | 2/1994 | WIPO . |
| 95/01479 | 1/1995 | WIPO . |
| 95/17548 | 6/1995 | WIPO . |
| 95/21298 | 8/1995 | WIPO . |
| 96/04424 | 2/1996 | WIPO . |

*Primary Examiner*—Henry F. Epstein
*Attorney, Agent, or Firm*—J. E. Ruland

[57] ABSTRACT

An absorbent folded hand towel having improved effectiveness at hand drying based on the weight of the towel. The towel is composed of an absorbent fibrous cellulosic web having in combination: 1) a total area of less than about 500 $cm^2$; 2) a basis weight of greater than about 45 gsm; 3) a TWA of greater than about 3 g/g; and 4) a unit tensile strength of less than about 1300 meters, so that the hand towel provides a hand towel utility of less than about 5 grams per hand dry event.

20 Claims, 3 Drawing Sheets

ABSORBENT FOLDED HAND TOWEL

FIELD OF THE INVENTION

This invention generally relates to the field of absorbent folded hand towels. More particularly, this invention relates to an absorbent folded hand towel having improved effectiveness at hand drying.

BACKGROUND

Absorbent folded hand towels made of fibrous cellulosic material are widely used to dry hands at commercial, institutional and public facilities. Such folded hand towels are designed for a single use to prevent the spread of pathogens. Since these towels are typically provided at no cost to the user, it is desirable to minimize their cost of use.

During each use or hand drying event, one or more hand folded towels are rubbed over the hands of a user to absorb water. The ability of an individual towel to absorb water (also called "water capacity") roughly correlates to the arrangement of fibers and total weight of absorbent fibrous cellulosic material in the towel (which is also a major component of the cost of such towels). It generally follows that increasing the water capacity of a towel also increases its weight and thus its cost.

One widely adopted approach to lowering the cost of using absorbent folded towels is to provide a towel having a "high capacity" and sufficiently large area so that only one towel would be needed for a typical hand drying event. In order to keep such towels from using too much fiber, the basis weight of such large format towels is often kept low. These towels may be made utilizing papermaking techniques or furnishes that provide sufficient strength at low basis weights to reduce or prevent the towel from tearing during dispensing. Alternatively, these towels may be configured so that two or more plies are folded to form a leading edge that has sufficient strength for reliable dispensing. Studies have shown that fewer of these "high capacity" towels are used in a hand drying event. Unfortunately, the greater weight of each "high capacity" towel means that the total weight of towel used during the hand drying event is relatively high. Exemplary high capacity towels have surface areas of 600 $cm^2$ or more and basis weights of 45 gsm or more.

Another approach to lowering the cost of using absorbent folded paper towels is to provide inexpensive "very low capacity" towels. The basis weight of these "very low capacity" towels is kept low so that less fiber is used. Such low basis weight towels are also made utilizing papermaking techniques or furnishes that provide sufficient strength at low basis weights to reduce or prevent the towel from tearing during dispensing. The problem with this approach is that users typically perceive these towels as ineffective at hand drying and take more towels per use causing the total weight of towel used during the hand drying event to be relatively high. Exemplary very low capacity towels have surface areas of less than 600 $cm^2$ and basis weights of 45 gsm or less.

Thus, there is a long and unfilled need for an absorbent towel that delivers the right amount of water capacity for users to dry their hands while minimizing the total weight of towel used during each hand drying event.

Meeting this need would have an important economic benefit by reducing the cost of hand towels to operators of commercial, institutional and public facilities. Meeting this need would also have an important environmental benefit by reducing the total weight of towel (i.e., fibrous cellulosic material) used during each hand drying event. That is, it is desirable to reduce the total weight of the folded towel that is used and the total weight of the folded towel that is discarded.

SUMMARY OF THE INVENTION

The problems and needs described above are addressed by the present invention which provides an absorbent folded hand towel having improved effectiveness at hand drying based on the weight and area of the towel. The folded towel is composed of an absorbent fibrous cellulosic web having in combination: 1) a total area of less than about 500 $cm^2$; 2) a basis weight of greater than about 45 gsm; 3) a TWA of greater than about 3 g/g; and 4) a unit tensile strength of less than about 1300 meters, so that the hand towel provides a hand towel utility of less than about 5 grams per hand dry event.

According to the invention, the towel desirably has a total area of less than about 450 $cm^2$. For example, the hand towel may have a total area of less than about 425 $cm^2$.

The towel desirably has a basis weight of greater than about 50 gsm. For example, the towel may have a basis weight of greater than about 60 gsm. It is also desirable that the towel has a TWA (total water absorbed) of 3.5 or greater. For example, the towel may have a TWA of 5.0 or more. As another example, the towel may have a TWA of 7.5 or more. As yet another example, the towel may have a TWA of 10 or more.

The towel desirably has a unit tensile strength of less than about 1000 meters. For example, the towel may have a unit tensile strength of less than about 900 meters. As another example, the towel may have a unit tensile strength of less than about 725 meters. As yet another example, the towel may have a unit tensile strength of less than about 500 meters.

It is also desirable that the towel provides a hand towel utility of less than about 4.8 grams per hand dry event. For example, the towel may provide a hand towel utility of less than about 4.5 grams per hand dry event. As another example, the towel may provide a hand towel utility of less than about 4.0 grams per hand dry event.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying description of the invention.

DETAILED DESCRIPTION

Figure 1A:
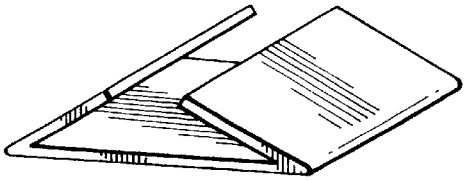
FIGS. 1A and 1B are illustrations of a conventional absorbent C-Fold towel having a relatively large area and relatively low basis weight.

As used herein, the term "total area" refers to the two dimensional surface area of a flat, generally rectangular or square material such as, for example, a paper towel. The total area is determined by multiplying the length dimension of the material by the width dimension of the material.

As used herein, the term "basis weight" refers to the weight of a material per specified unit of surface area. This measurement is usually associated with relatively thin, flat, sheet-like materials such as, for example, papers, webs and the like. Basis weights of the materials discussed herein were determined essentially in accordance with TAPPI Test Method No. T410om-88. Basis weight is expressed in units of weight per unit area (e.g., grams per square meter or ounces per square yard).

As used herein, the term "unit tensile" refers to the geometric mean value of the machine direction tensile strength and the cross-machine direction tensile strength normalized for the basis weight of the sample. Tensile strength values are measured by a breaking length test (TAPPI Test Method No- T494om-88) using 5.08 cm sample span and 5.08 cm/minute cross head speed. Typically, towel strengths are different in the machine direction versus cross machine direction of the sheet. Also, the basis weight of towel samples vary which affects tensile strength. In order to better compare tensile strengths from various samples it is important to compensate for the differences in basis weight of the samples and for machine directional differences in tensile strength. Compensation is achieved by calculating a basis weight and directionally normalized tensile strength, hereinafter "Unit Tensile Strength" or "Unit Tensile"). Unit Tensile is calculated as the quotient obtained by dividing the basis weight into the square root of the product of the machine direction and cross machine direction tensile strengths. Tensile strength calculations normalized for differences in basis weight and machine direction have been devised for better comparisons of samples. When English units of measurement are used, tensile strength is measured in ounces per inch and basis weight in pounds per ream (2880 square feet). When calculated in metric units the tensile strength is measured in grams per 2.54 centimeters and the basis weight is measured in grams per square meter. It should be noted that the metric units are not pure metric units because the test apparatus used for testing tensile is set up to cut a sample in inches and accordingly the metric units comes out to be grams per 2.54 centimeters. Using the abbreviations MDT for machine direction tensile, CDT for cross machine direction tensile and BW for basis weight, the mathematical calculation of Unit Tensile Strength is:

Unit Tensile Strength $=(MDT \times CDT)^{1/2}/BW$ Unit Tensile Strength in English units $=0.060 \times$the Unit Tensile Strength in the above defined metric units.

As used herein, the term "hand towel utility" or "utility" refers to weight of hand towel used during a hand drying event. This value is determined by multiplying the towel usage (i.e., number of towels used per hand drying event) by the towel weight. Hand towel utility is expressed in units of "weight/hand drying event" or "Wt/HD".

As used herein, the terms "Total Water Absorbency" or "TWA" or "Absorbency" refer to a measure of water absorbed per unit weight of an absorbent paper product. For purposes of the present invention, the TWA of the paper products is determined by measuring the amount of a liquid absorbed by the paper product after being submerged in a liquid bath at approximately 23° C. and allowed to fully wet out.

More specifically, the absorbency is determined by first cutting a 7.62 cm ×7.62 cm specimen of the material to be evaluated, conditioning the specimen at 23° C. and 50% Relative Humidity, and weighing the specimen. This is recorded in units of grams as $W_1$. Two drainage strips should also be cut from the same material.

A wire screen constructed of standard grade reinforced stainless steel wire cloth is lowered into the liquid bath. Using blunt edge tweezers, the specimen is positioned in the liquid bath over the screen and submerged for two minutes. After two minutes, the specimen is positioned over the screen so that it is aligned with the bottom corner of the screen. The screen is raised and the specimen is allowed to drain for a few seconds before the drainage strip is attached. The specimen with attached drainage strip is then clamped to a specimen holder, hung on a rod over a drainage tank and allowed to drain for 30 minutes. Next, the specimen is detached from the specimen holder by releasing the drainage clamps and placed in a weighing tray of a balance. The wet sample is weighed and this weight is recorded in units of grams as $W_2$. The liquid weight is obtained from the formula:

$$\text{Liquid Weight}=W_2-W_1$$

Assuming the density of water to be 1 gram per milliliter, a Test Capacity of the sample can be calculated by dividing the liquid weight by the area of the sample. The Test Capacity is expressed in units of milliliters per square centimeter. The Total Water Absorbency (TWA) in Grams per Gram is obtained from the formula:

$$\text{TWA(g/g)}=\text{Liquid Weight}/W_1$$

Tests were conducted utilizing distilled or deionized water to determine Total Water Absorbency. Liquid in the liquid bath was changed after each sample to avoid possible contamination by treatments that might be present on the test specimens.

As used herein, the terms "Water Capacity" or "Capacity" refer to the amount of water that is able to be absorbed by an individual towel. Water Capacity is determined by multiplying the Test Capacity (described above) by the Towel Area (described above). The Water Capacity is expressed in units of milliliters of water per towel (mL/towel).

As used herein, the term "quality" or "hand towel quality" is a measure of the perceptions of the overall quality of a towel as used. This perceived quality is related to a number of variables including softness, total water absorbency, water capacity, comfort during drying, strength and to a lesser extent, appearance. For purposes of the present invention, perceptions of hand towel quality are measured for individual test participants in a Hand Towel Test using the methodology described below. The results of these tests are recorded and an average value for all the tests is reported as the "quality" or "hand towel quality" based on a scale of 1 to 10 where 1 is the lowest score and 10 is the highest score.

The present invention is based upon the discovery that the effectiveness of a towel at hand drying may be improved so that a lower total weight of the towel (i.e., fibrous cellulosic material) is used during each hand drying event or at an equal weight of towel a superior quality perception can be achieved. Generally speaking, the improvement is accomplished using smaller towels having a certain combination of properties. This approach is contrary to the conventional belief that using smaller towels provides no reduction or even an increase in the amount of towels (i.e., total weight of towel or fibrous cellulosic material) used during each hand drying event and a concomitant reduction in quality perceptions.

Figure 1B:
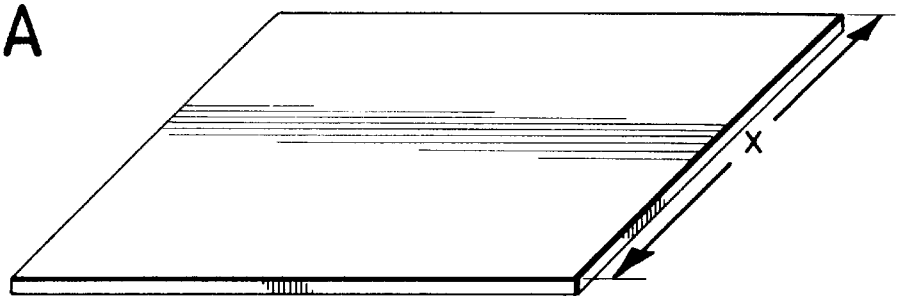

FIG. 1A is an illustration (not to scale) of a conventional absorbent C-Fold hand towel having a relatively large area and relatively low basis weight. The C-Fold hand towel is shown in its folded state. FIG. 1B is an illustration of a the towel shown in FIG. 1A in an unfolded state. It can be noted that the towel has a width "x" and a relatively long length. Shading along the edges of the towel is generally intended to represent that the towel has a relatively dense structure. The conventional belief is that fewer absorbent hand towels are used per hand dry event when the towel has a very large area if the overall Water Capacity of the towel is high.

Figure 2A:
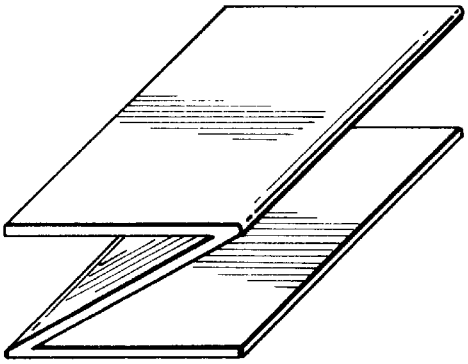
FIGS. 2A and 2B are illustrations of a conventional absorbent M-Fold towel having a relatively large area and relatively low basis weight.
Figure 2B:
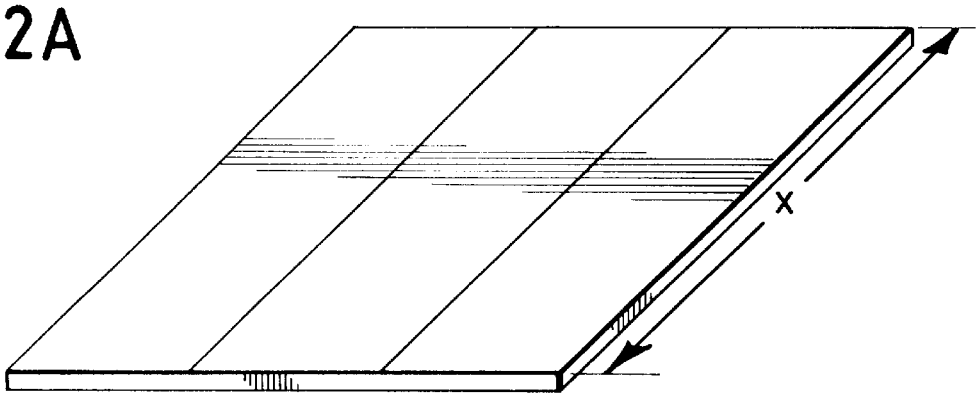

FIG. 2A is an illustration (not to scale) of a conventional absorbent M-Fold hand towel having a relatively large area and relatively low basis weight. The M-Fold hand towel is shown in its folded state. FIG. 2B is an illustration of a the towel shown in FIG. 2A in an unfolded state. It can be noted that the towel has a width "x" which is generally the same as the C-Fold towel but with a shorter length. Shading along the edges of the towel is generally intended to represent that the towel has a relatively dense structure.

Figure 3A:
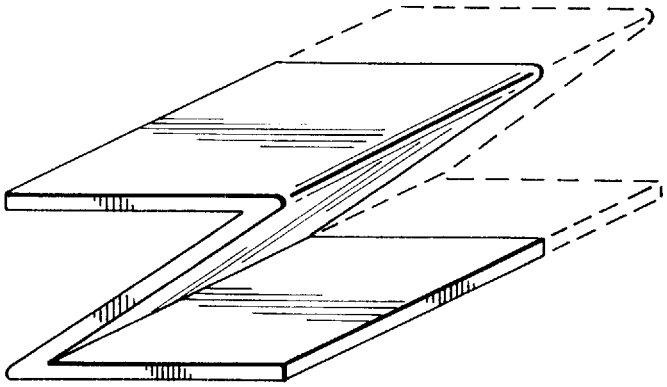
FIGS. 3A and 3B are illustrations of an exemplary improved absorbent folded hand towel having increased effectiveness at hand drying.
Figure 3B:
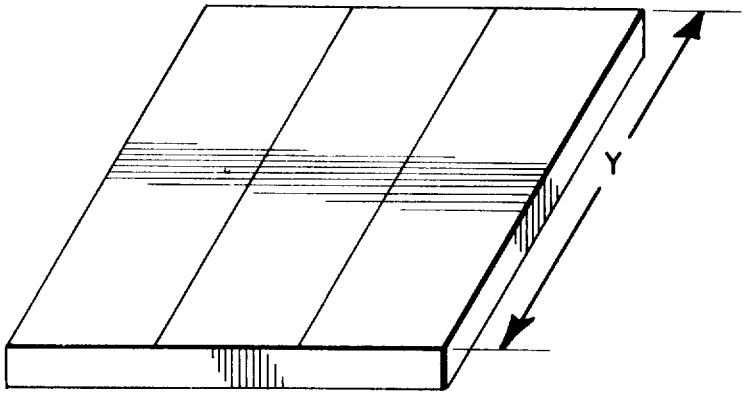
Figure 4:
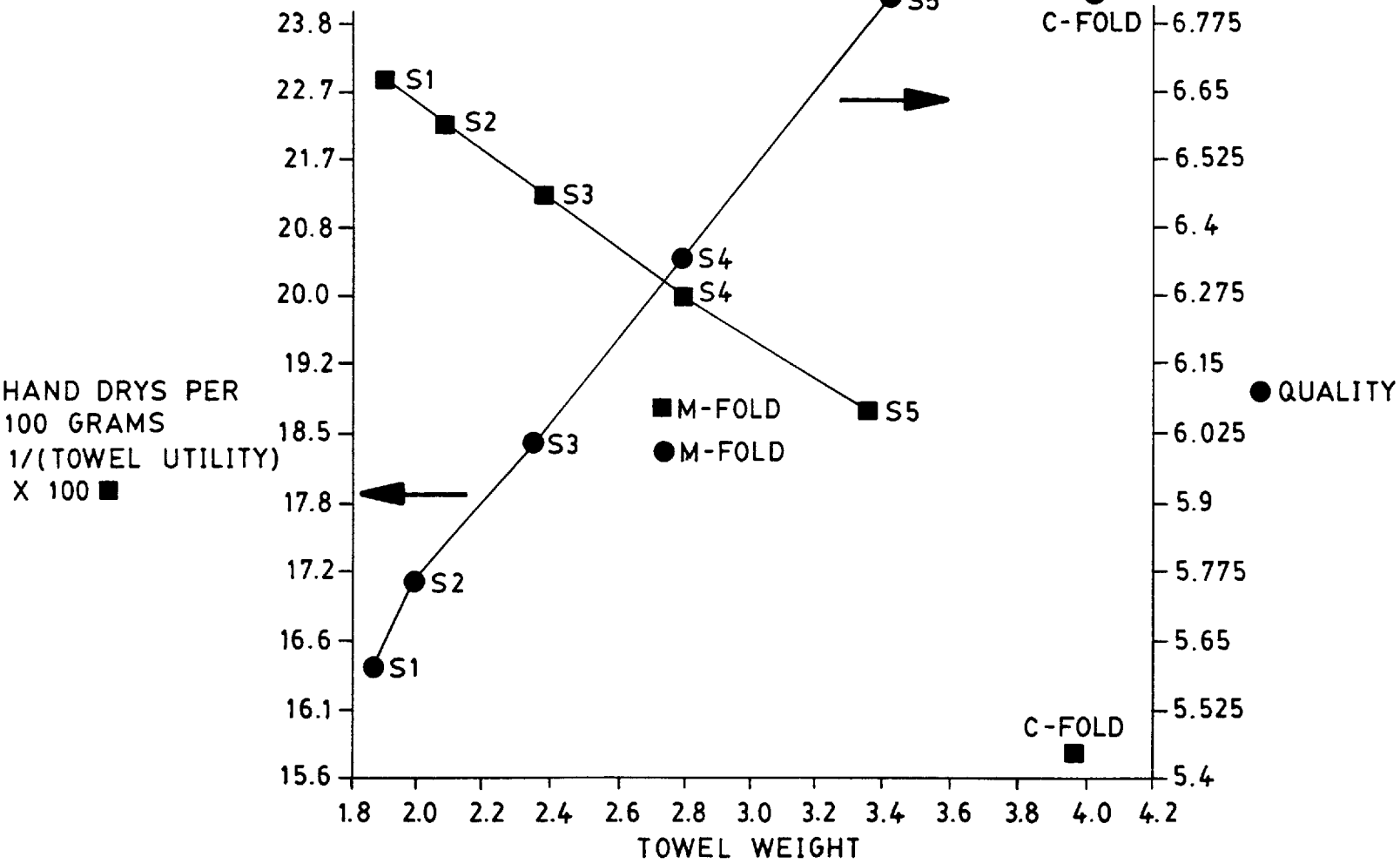
FIG. 4 graphically shows the relationship between towel weight and inverse towel utility as well as the relationship between towel weight and quality.

FIG. 3A is an illustration (not to scale) of an exemplary improved absorbent folded hand towel having increased effectiveness at hand drying. This hand towel is shown in a M-Fold format. The improved towel is much smaller in area and greater in basis weight and has relatively high levels of absorbency (i.e., TWA). As can be seen from the dashed lines, the improved folded hand towel has a smaller width than the towel shown in FIG. 2A. FIG. 3B is an illustration of a the towel shown in FIG. 3A in an unfolded state. It can be noted that the towel has a width "y" which is smaller than the width "x" shown in FIGS. 1B and 2B. Shading along the edges of the towel is generally intended to represent that the towel has a structure with relatively lower density than the towels shown in FIGS. 1 and 2.

The improved hand towel is composed of an absorbent fibrous cellulosic web having in combination: 1) a total area of less than about 500 $cm^2$; 2) a basis weight of greater than about 45 gsm; 3) a TWA of greater than about 3 g/g; and a unit tensile strength of less than about 1300 meters, so that the hand towel provides a hand towel utility of less than about 5 grams per hand dry event.

According to the present invention, the area and basis weight of the towel are desirably adjusted to keep the towel weight between from about 1.87 grams to about 3.36 grams. Importantly, the total area of the towel is less than about 500 $cm^2$ and the basis weight is greater than about 45 gsm.

By reducing the size of the towel and increasing the basis weight, the unit tensile strength of the towel may be decreased significantly without compromising the actual strength of the towel. That is, the fibrous cellulosic web or basesheet used in the towel may be made utilizing papermaking techniques, post-treatments and/or fibers that enhance absorbency.

For example, absorbent paper products such as hand towels may contain a preponderance of coarse, high yield fibers, typically stone groundwood (SGW), thermomechanical pulp (TMP), and/or chemithermomechanical pulp (CTMP) fibers. Such coarse fibers are usually highly refined to cause fractures and fibrillations which aid in imparting strength to the resulting paper product so it has sufficient strength to dispense without tearing. Such refining changes the freeness of the coarse fiber from "high" freeness fibers to "low" freeness fibers. When formed into paper products, these highly refined, high-yield, coarse, mechanically pulped fibers, the resulting sheets have lower levels of absorbency (e.g., Total Water Absorbed as determined for a unit weight of towel).

In an aspect of the present invention, the increased basis weight of the absorbent hand towel permits relatively coarse fibers such as, for example, those described above or northern softwood kraft (NSWK) pulp fibers, recycled fibers (RC), hardwood kraft (HWK) pulp fibers, or stone ground wood (SGW) pulp fibers to be processed with less refining to yield a weaker but more absorbent product. Alternatively and/or additionally, the towel may be composed of or may include resilient fibers such as, for example, chemithermomechanical pulp (CTMP) fibers or various types of modified fibers.

Moreover, the absorbent hand towel may be made utilizing a papermaking process in which less pressure is applied in the press section of a conventional Fourdrinier papermaking machine. It is thought that reducing the pressure applied at that point in the papermaking process yields a more open fiber structure or network of fibers in the resulting sheet. Such an open fiber structure or network of fibers typically provides higher levels of absorbency compared to a closed, tight or collapsed fiber structure or network.

The papermaking process may include steps such as, for example, differential speed transfers and the like to create or enhance an open fiber structure or network of fibers. Alternatively and/or additionally, non-compressive drying operations such as, for example, through-air drying operations may be used to enhance the open fiber structure or network of fibers.

In another aspect of the present invention, the increased basis weight of the absorbent hand towel permits greater levels of mechanical debonding (e.g., creping, hydraulic needling, brushing, embossing, etc.) to open up the fiber structure or network. Mechanical debonding typically enhances absorbency but reduces strength. Lower unit tensil strength provides a softer, more flexible sheet. Although the inventor should not be held to any particular theory of operation, it is believed that the absorbent hand towels of the present invention require less tensile strength than conventional hand towels because their smaller area generates less frictional forces or resistance during dispensing. Accordingly, these towels may be more absorbent yet still have lower overall strength than conventional towels which affords better performance and better quality perceptions.

Debonding of fibers can also be accomplished chemically by adding chemical debonding agents. While such chemical debonding agents reduce strength and increase softness of the resulting paper products, they typically have minimal impact on absorbency. Generally speaking, chemical debonding agents appear to do little to open up the fiber structure or network in the absence of other modifications to the papermaking process.

Accordingly, one feature of the present invention is that desirable levels of absorbency (e.g., TWA greater than about 3 g/g) are present in combination with levels of unit tensile strength less than about 1300 meters.

It was unexpectedly discovered that the combination of small towel size, high basis weight, relatively high absorbency and lower unit tensile strength resulted in a hand towel that provides a utility of less than about 5 grams per hand dry event. Moreover, it was unexpectedly discovered that the perceived quality of the these hand towel by users would fall within the relatively high range of much larger area "high capacity" hand towels having lower measured levels of utility.

The absorbent towel is typically a folded web such as, for example, a folded paper web. Since the towel of the present invention has relatively high basis weight, small area, and sufficient strength for reliable dispensing, the towel may have a single ply and may have relatively simple fold patterns. For example, the towel may have a simple overfold pattern or a simple interfold pattern instead of more complex patterns that provide two or more layers of a towel folded for strength to form the leading towel edge protruding from the dispenser. Alternatively and/or additionally, the absorbent folded towel may be composed of multiple plies joined by crimp-bonding, laminating, or other techniques to yield a towel with a relatively high total basis weight from individual low basis weight plies. In such embodiments, the unit tensile strength for the folded towel (i.e., the towel composed of individual plies) should be less than about 1300 meters.

Generally speaking, the absorbent folded towel may be an absorbent paper towel manufactured by conventional papermaking techniques and may contain conventional fibers used in absorbent towels. Alternatively and/or additionally, the absorbent folded towel may be manufactured utilizing processes such as, for example, those described in U.S. Pat. Nos. 5,048,589 and 5,137,600, the entire contents of which are incorporated herein by reference.

Folded Hand Towel Test

Apparatus

The test method requires no special apparatus. The test method uses the procedures and materials described below to evaluate absorbent folded towel samples using test participants. These test participants are observed during their use of the samples to determine certain information. After using the samples, test participants are asked to respond rate the samples in response to standard questions.

Methodology

People were recruited to take part in a soap test, thus diverting attention away from the fact that folded towels were being studied. They were asked to wash their hands three times and the number of towels used each time was recorded by the interviewers. Other aspects of test participant's behavior and towel performance were noted at this stage.

The multiple hand washings by each test participant (i.e., wash and dry their hands three times) allows an element of learning about each product to take place, so that behavior can be modified accordingly if necessary. Analysis is based primarily on the third wash results as this allows users to familiarize themselves with the towels and dispensing mechanisms, and is believed to represent the most natural situation with participants drying their hands most thoroughly.

The towels were tested monadically and were dispensed through the correct dispensers wherever possible. Dispensers were mounted on stands which either stood on tables or were hung over doors and set at a height of 1.3 meters above the floor.

The soap used was consistent across all tests and was provided in pump dispensers in order to control, as far as possible, the amount used by each respondent. All soap, towels and dispensers used were unbranded.

One sleeve of each product was returned to laboratories for testing of the basesheet. Water samples were taken from each location and also tested for softness/hardness as this might affect the ease of rinsing off soap and, hence, the number of towels used.

Observation of Test Participants

During the test, participants were observed to answer the following:

"How many hands did respondent use to remove paper towel?"

"Number of towels used to dry hands?"

"If more than one(towel): Were these used individually or together?"

After the third hand dry, participants were taken away from the basins and an short interview was conducted in which participants were asked:

to give spontaneous comments on the towels used;

to rate the towels for quality, effectiveness, strength, and comfort;

to comment on the size of towel;

to give details of the type of hand drying methods used at work, and how the towels tested compared with these.

Standard Questions

After the third hand dry, each participant was questioned about a list of features associated with folded paper towels. They were asked to rate the towels using a 10 point scale where 1 means very poor and 10 means excellent. In particular, participants were asked to rate:

". . . (t)he overall quality of the paper towels you used"

"The towel's comfort during drying"

"The towel's color and appearance"

"The towel's strength"

"The overall effectiveness of the towel for drying your hands"

The test participants were also asked to rate the size of the towels using a 6 point scale where 1 means "much too big"; 2 means "a little too big"; 3 means "about the right size"; 4 means "a little too small"; and 5 means "much too small".

EXAMPLE 1

Using the methodology described above, approximately 1600 tests at various sites were conducted utilizing the following samples:

a single ply C-Fold absorbent paper towel available from Kimberly-Clark Corporation, Roswell, Ga.;

a single ply M-Fold absorbent paper towel available from Kimberly-Clark Corporation, Roswell, Ga.;

five experimental M-fold absorbent paper towel manufactured utilizing essentially the same furnish and papermaking techniques as the commercially available products described above. Each experimental towel had the same area and overall MD and CD Tensile strengths, but different basis eights and Unit Tensile strengths.

During each test, numbers of towels used per hand dry event were observed as described above. The results are reported in Table 1. Hand Towel Utility was calculated from the data and is reported in Table 1. After each test, participants responded to standard questions and hand towel "quality" values were determined. These results are reported in Table 1.

During the tests, various towel samples were measured for length and width and an area was calculated. These results are reported in Table 1.

Towel weights were determined to the nearest one-hundredth gram by conventional techniques. Basis weight of the towels were measure as described above. These results are reported in Table 1.

Machine direction tensile strength and cross machine direction tensile strengths were measured for the samples according to the method described above and are reported in Table 1 under the column headings "MD Tensile" and "CD Tensile", respectively. Unit Tensile Strength was calculated as described above and is reported under the column heading "Unit Tensile".

Total Water Absorbed values for samples were determined according to the procedure described above and are reported under the column heading "TWA". The TWA values were used to calculated water capacities as described above. The results are reported in Table 1.

As can be seen from Table 1, the large area C-fold towel has the greatest water capacity and towel weight. It has the lowest level of utility and a high level of quality. This towel also has a relatively low unit tensile which corresponds to a relatively high TWA.

TABLE 1

| Product units | Length mm | Width mm | Area $cm^2$ | Basis Weight gsm | Towel Weight grams | MD Tensile oz/in | CD Tensile oz/in | Unit Tensile meters | TWA g/g | Water Capacity mL/towel | Usage Twls/HD | Utility Wt/HD | Quality (1–10) |
|---|---|---|---|---|---|---|---|---|---|---|---|---|---|
| C-Fold (150) | 340 | 264 | 898 | 44.3 | 3.98 | 42 | 20 | 731 | 3.84 | 15.3 | 1.58 | 6.3 | 6.81 |
| M-Fold (180) | 2.39 | 2.36 | 564 | 48 | 2.71 | 75 | 35 | 1192 | 3.04 | 8.2 | 1.97 | 5.3 | 6.01 |
| Sample 1 | 2.39 | 1.78 | 425 | 44 | 1.87 | 75 | 35 | 1301 | 2.90 | 5.4 | 2.33 | 4.4 | 5.61 |
| Sample 2 | 2.39 | 1.78 | 425 | 48 | 2.04 | 75 | 35 | 1192 | 3.04 | 6.2 | 2.20 | 4.5 | 5.76 |
| Sample 3 | 2.39 | 1.78 | 425 | 55 | 2.34 | 75 | 35 | 1041 | 3.26 | 7.6 | 2.01 | 4.7 | 6.01 |
| Sample 4 | 2.39 | 1.78 | 425 | 65 | 2.77 | 75 | 35 | 881 | 3.54 | 9.8 | 1.79 | 5.0 | 6.35 |
| Sample 5 | 2.39 | 1.78 | 425 | 79 | 3.36 | 75 | 35 | 725 | 3.85 | 12.9 | 1.57 | 5.3 | 6.81 |

The M-fold towel has a smaller area than the C-fold, a moderate towel weight and water capacity. The smaller area of the M-fold towel resulted in greater towel usage (i.e., more towels used per hand dry event) even though the basis weight was greater.

The Sample 1 towel has a small area (425 $cm^2$), the lowest towel weight, towel quality, water capacity and TWA, the greatest unit tensile strength and best level of utility. The much smaller towel area (compared to the C-fold towel) and the similar basis weights resulted in much greater towel usage.

As can be seen in Table 1 for Samples 1–5, when the towel area, MD Tensile and CD Tensile remain constant and the basis weight and TWA is increased, there is an unexpected decrease in towel usage that results in good levels of towel utility (i.e., towel utility values of less than about 5 grams/hand dry) and an unexpected increase in perceived towel quality.

Referring now to FIG. 3, the relationship between towel utility, towel quality and towel weight and area is shown in graphical form. More specifically, FIG. 3 is a graph with towel weight on the X-axis and the inverse towel utility (i.e., 1/(towel utility)) forming one Y-axis and towel quality as another Y-axis. Data for Samples 1–5 from Table 1 are plotted at points identified as S1 to S5, respectively. Data for the M-Fold and C-Fold towels from Table 1 are plotted at points identified as M-Fold and C-Fold, respectively. Data for the towel quality are represented by the symbol "●" and data for the inverse towel utility are represented by the symbol "■".

As can be seen from FIG. 3, the large C-Fold towel has very high quality and very low utility. The M-Fold towel having less area exhibits a better level of utility but lower quality. Samples 1–5 exhibit increasing levels of quality. Sample 3 has the same quality as the M-Fold towel yet has greater utility. Sample 5 has the same high quality as the C-Fold towel yet has the same level of utility as the M-Fold towel.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. An absorbent folded hand towel having improved effectiveness at hand drying based on the weight of the towel, the towel comprising an absorbent fibrous cellulosic web having in combination:

a total area of less than about 500 $cm^2$;

a basis weight of greater than about 45 gsm;

a TWA of greater than about 3 g/g; and a unit tensile strength of less than about 1300 meters, so that the hand towel provides a hand towel utility of less than about 5 grams per hand dry event.

2. The hand towel of claim 1, wherein the towel has a total area of less than about 400 $cm^2$.

3. The hand towel of claim 1, wherein the towel has a total area of less than about 325 $cm^2$.

4. The hand towel of claim 1, wherein the towel has a basis weight of greater than about 50 gsm.

5. The hand towel of claim 1, wherein the towel has a basis weight of greater than about 60 gsm.

6. The hand towel of claim 1, wherein the towel has a unit tensile strength of less than about 900 meters.

7. The hand towel of claim 1, wherein the towel has a unit tensile strength of less than about 725 meters.

8. The hand towel of claim 1, wherein the towel provides a hand towel utility of less than about 4.5 grams per hand dry event.

9. The hand towel of claim 1, wherein the towel provides a hand towel utility of less than about 4.0 grams per hand dry event.

10. An absorbent folded hand towel having improved effectiveness at hand drying based on the weight of the towel, the towel comprising an absorbent fibrous cellulosic web having in combination:

a total area of less than about 500 $cm^2$;

a basis weight of greater than about 45 gsm;

a TWA of greater than about 3 g/g;

a towel weight of from about 1.9 to about 3.4 grams; and a unit tensile strength of less than about 1300 meters, so that the hand towel provides a hand towel utility of less than about 5 grams per hand dry event.

11. The hand towel of claim 10, wherein the towel has a total area of less than about 400 $cm^2$.

12. The hand towel of claim 10, wherein the towel has a total area of less than about 325 $cm^2$.

13. The hand towel of claim 10, wherein the towel has a basis weight of greater than about 50 gsm.

14. The hand towel of claim 10, wherein the towel has a basis weight of greater than about 60 gsm.

15. The hand towel of claim 10, wherein the towel has a unit tensile strength of less than about 900 meters.

16. The hand towel of claim 10, wherein the towel has a unit tensile strength of less than about 725 meters.

17. The hand towel of claim 10, wherein the towel provides a hand towel utility of less than about 4.5 grams per hand dry event.

18. The hand towel of claim 10, wherein the towel provides a hand towel utility of less than about 4.0 grams per hand dry event.

19. The hand towel of claim 10, wherein the towel has a weight of from about 2.0 to about 3.0 grams.

20. The hand towel of claim 10, wherein the towel has a weight of from about 2.25 to about 2.75 grams.

* * * * *